US005964210A

United States Patent [19]

Hodsden

[11] Patent Number: 5,964,210

[45] Date of Patent: Oct. 12, 1999

[54] APPARATUS AND METHOD FOR SLICING A WORKPIECE UTILIZING A DIAMOND IMPREGNATED WIRE

[75] Inventor: John B. Hodsden, Colorado Springs, Colo.

[73] Assignee: Laser Technology West Limited, Colorado Springs, Colo.

[21] Appl. No.: 08/993,007

[22] Filed: Dec. 18, 1997

Related U.S. Application Data

[63] Continuation-in-part of application No. 08/888,952, Jul. 7, 1997, Pat. No. 5,878,737.

[51] Int. Cl.[6] ..... B28D 1/08

[52] U.S. Cl. ..... 125/21; 125/16.01; 451/304; 451/299

[58] Field of Search ..... 451/296, 299, 451/304; 125/12, 16.01, 16.02, 21

[56] References Cited

U.S. PATENT DOCUMENTS

| | | | |
|---|---|---|---|
| 3,478,732 | 11/1969 | Clark et al. | 125/21 |
| 4,727,852 | 3/1988 | Schmid et al. | 125/160.1 |
| 5,564,409 | 10/1996 | Bonzo et al. | 125/16.02 |
| 5,616,065 | 4/1997 | Egglhuber | 125/21 |
| 5,628,301 | 5/1997 | Katamachi | 125/21 |
| 5,699,782 | 12/1997 | Toyama | 125/16.02 |
| 5,715,806 | 2/1998 | Tonegawa | 125/21 |

FOREIGN PATENT DOCUMENTS

| | | | |
|---|---|---|---|
| 2604464 | 11/1977 | Germany | 125/21 |
| 591328 | 2/1978 | U.S.S.R. | 125/16.02 |

OTHER PUBLICATIONS

Laser Technology West Limited Brochure, "Diamond Wire Selection".

Laser Technology West Limited Brochure, "Solid State Controller/Capstan/Accessories".

Laser Technology West Limited Brochure, "Cutting with Diamond Wire".

Laser Technology West Limited Brochure, "Model 203000/ Vertical Wire Saw".

Laser Technology West Limited Brochure, "Model 214000/ Crystal Wire Saw".

Laser Technology West Limited Brochure, "Model 206000/ Laboratory Wire Saw".

Laser Technology West Limited Brochure, "Model 208000/ Guillotine Series Saws".

Laser Technology West Limited Brochure, "Automatic Guillotine Series Saws".

Laser Technology West Limited Brochure, "Model 228120/ Profile Wire Saw".

*Primary Examiner*—Eileen P. Morgan

*Attorney, Agent, or Firm*—William J. Kubida; John R. Wahl; Holland & Hart LLP

[57] ABSTRACT

An apparatus and method for slicing a workpiece, in particular, a polysilicon or single crystal silicon ingot, utilizing a diamond impregnated wire saw in which either the workpiece (or ingot) is rotated about its longitudinal axis or the diamond wire saw is rotated about the longitudinal axis of the workpiece as the diamond wire is driven orthogonally to the longitudinal axis of the workpiece and advanced from a position tangentially adjoining the outer diameter ("OD") of the ingot to a position tangential to its center or inner diameter ("ID"). In this manner, the diamond wire cuts through the workpiece at a substantially tangential point to the circumference of the cut instead of straight through up to the entire diameter of the piece and single crystal silicon ingots of 300 mm to 400 mm or more may be sliced into wafers relatively quickly, with minimal 'kerf" loss and less extensive follow-on lapping operations.

30 Claims, 7 Drawing Sheets

10'

APPARATUS AND METHOD FOR SLICING A WORKPIECE UTILIZING A DIAMOND IMPREGNATED WIRE

CROSS REFERENCE TO RELATED APPLICATIONS

This application is a continuation-in-part application of U.S. patent application Ser. No. 08/888,952, filed Jul. 7, 1997 now U.S. Pat. No. 5,878,737.

BACKGROUND OF THE INVENTION

The present invention relates, in general, to the field of an apparatus and method for accurately sawing, a workpiece into two or more sections. More particularly, the present invention relates to an apparatus and method for cropping and/or slicing crystalline ingots, such as relatively large diameter polysilicon and single crystal silicon ingots, with great accuracy, speed and efficiency.

The vast majority of current semiconductor and integrated circuit devices are fabricated on a silicon substrate. The substrate itself is initially created utilizing raw polycrystalline silicon having randomly oriented crystallites. However, in this state, , the silicon does not exhibit the requisite electrical characteristics necessary for semiconductor device fabrication. By heating, high purity polycrystalline silicon at temperatures of about 1400 degrees, a single crystal silicon seed may then be added to the melt and a single crystalline ingot pulled having the same orientation of the seed. Initially, such silicon ingots had relatively small diameters of on the order of from one to four inches, although current technology can produce ingots of 150 mm (six inches) or 200 mm (eight inches) in diameter. Recent improvements to crystal growing technology now allow ingots of 300 mm (twelve inches) or 400 mm (sixteen inches) in diameter to be produced.

Once the ingot has been produced, it must be cropped (i.e. the "head" and "tail" portions of the ingot must be removed) and then sliced into individual wafers for subsequent processing into a number of die for discrete or integrated circuit semiconductor devices. The primary method for cropping the ingot is through the use of a bandsaw having a relatively thin flexible blade. However, the large amount of flutter inherent in the bandsaw blade results in a very large "kerf" loss and cutting blade serration marks which must then be lapped off.

At present, there are two primary techniques for slicing an ingot into wafers: the ID (inner diameter) hole saw and the slurry saw. The former is used predominantly in the United States in order to slice single crystal silicon and is so named due to the fact that the cutting edge of the blade adjoins a centrally located hole at its inner diameter in an attempt to reduce the flutter of the blade and resultant damage to the crystalline structure. Among the disadvantages inherent in this technique is that as silicon ingots increase in diameter, the ID hole saw must increase to three times the ingot diameter to allow it to cut all the way through the ingot to a point at which it becomes unwieldy if not unworkable.

As previously mentioned, an alternative technique also utilized in the United States but used primarily in the Pacific Rim countries is the slurry saw. The slurry saw comprises a series of mandrels about which a very long wire is looped and then driven through the ingot as a silicon carbide or boron carbide slurry is dripped onto the wire. Wire breakage is a significant problem and the saw down time can be significant when the wire must be replaced. Further, as ingot diameters increase to 300 mm to 400 mm the drag of the wire through the ingot reaches the point where breakage is increasingly more likely unless the wire gauge is increased resulting in greater "kerf" loss. Importantly, a slurry saw can take many hours to cut through a large diameter ingot.

As is the case with the ID hole saw technique as well, excessive "kerf" loss results in less wafers being able to be sliced from a given ingot with a concomitant greater cost per wafer. Moreover, the score marks of the ID hole saw and less than even cutting of the slurry saw wires result in an increased need for lengthy and expensive lapping operations to make the surfaces of the wafer smooth and parallel as well as to remove other surface markings and defects. This excessive lapping also requires even greater amounts of silicon carbide and oil or aluminum oxide slurries, the ultimate disposal of which gives rise to well known environmental concerns.

Laser Technology West, Limited, Colorado Springs, Colo., a manufacturer and distributor of diamond impregnated cutting wires and wire saws, has previously developed and manufactured a proprietary diamond impregnated wire marketed under the trademarks Superwire™ and Superlok™. These wires comprise a very high tensile strength steel core with an electrolytically deposited surrounding copper sheath into which very small diamonds (on the order of between 20 to 120 microns) are uniformly embedded. A nickel overstrike in the Superlok wire serves to further retain the cutting diamonds in the copper sheath. The technique of cutting fixed workpieces with a direction reversing diamond wire is one that has been utilized, to date, primarily in a laboratory environment and not in a production process due to the inherently very slow cutting speed involved.

SUMMARY OF THE INVENTION

Disclosed herein is an apparatus and method for slicing a workpiece, in particular, a polysilicon or single crystal silicon ingot utilizing a diamond impregnated wire in which the workpiece (or ingot) is rotated about its longitudinal axis relative to the diamond wire as the diamond wire is driven orthogonally to the longitudinal axis of the workpiece and advanced from a position adjoining the outer diameter ("OD") of the ingot towards its inner diameter ("ID"). This relative motion between the wire and the workpiece in addition to the orthogonal wire movement is accomplished by either rotating the workpiece about its longitudinal axis or rotating the saw wire about the longitudinal axis of the workpiece during the cutting operation. In this manner, the diamond wire cuts through the workpiece at a point substantially tangential to the circumference of the cut instead of through up to the entire diameter of the piece. Through use of this technique, polysilicon or single crystal silicon ingots of 300 mm to 400 mm or more may be sliced into wafers relatively quickly, with minimal 'kerf" loss and less extensive follow-on lapping operations. The apparatus and method of the present invention results in more wafers being able to be sliced from a given ingot more quickly and with less subsequent processing translating into significant cost savings.

Particularly disclosed herein is a method for sectioning a substantially cylindrical crystalline workpiece. The method comprises the steps of providing a wire having a plurality of cutting elements affixed thereto and moving the wire orthogonally to a longitudinal axis of the workpiece while either rotating the workpiece about its longitudinal axis or rotating the wire about the workpiece longitudinal axis and advancing the wire from a first position proximate an outer diameter of the workpiece to a second position proximate its inner diameter or center.

Also disclosed herein is an apparatus for sectioning a substantially cylindrical crystalline workpiece. One embodiment of the apparatus comprises a wire having a plurality of cutting elements affixed thereto and a wire drive mechanism for moving the wire orthogonally with respect to a longitudinal axis of the workpiece, a workpiece rotation mechanism coupled to the workpiece for rotating the workpiece about its longitudinal axis, and a wire advancing mechanism which positions the wire from a first tangential position proximate an outer diameter of the workpiece to a second position proximate an inner diameter or center thereof.

A second embodiment is similar to the first except that the workpiece is held stationary on a frame and the wire drive mechanism is rotated about the workpiece by a rotation mechanism while the wire advancing mechanism positions the wire from the first position proximate an outer diameter of the workpiece to a second position proximate an inner diameter thereof.

Still further disclosed herein is a semiconductor wafer made by a process which comprises the steps of providing a wire having a plurality of cutting elements affixed thereto, moving the wire orthogonally to a longitudinal axis of a crystalline semiconductor material ingot, rotating either the wire or ingot about the ingot's longitudinal axis and advancing the wire from a first position proximate an outer diameter of the ingot to a second position proximate an inner diameter thereof.

BRIEF DESCRIPTION OF THE DRAWINGS

The aforementioned and other features and objects of the present invention and the manner of attaining them will become more apparent and the invention itself will be best understood by reference to the following description of a preferred embodiment taken in conjunction with the accompanying drawings, wherein.

DESCRIPTION OF THE INVENTION

Figure 1:
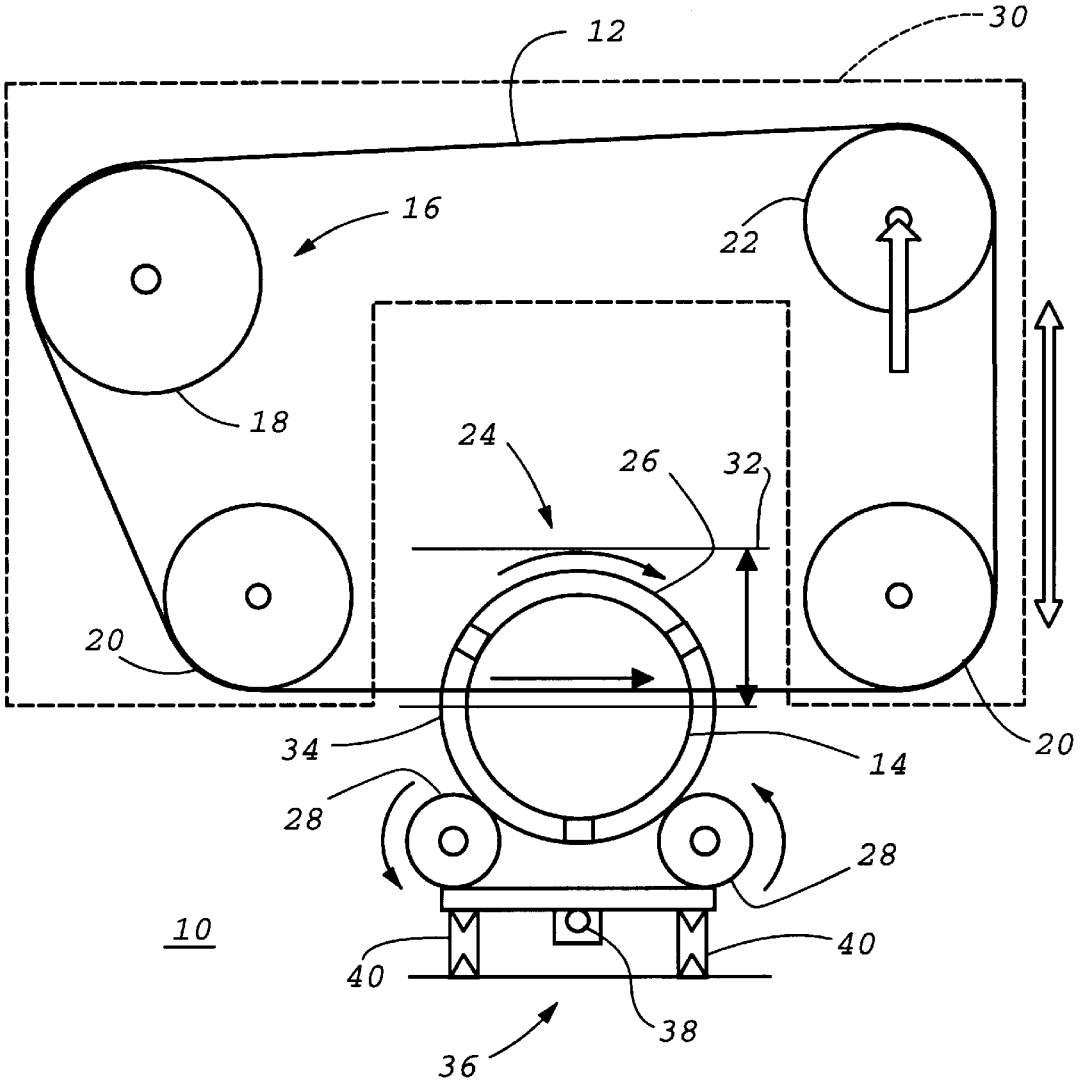
FIG. 1 is a simplified representational view of an apparatus for slicing a workpiece, in particular a single crystal silicon ingot, in accordance with an exemplary implementation of the present invention.

With reference now to FIG. 1, a simplified representational view of an apparatus 10 for slicing a generally cylindrical workpiece, for example, a polysilicon or single crystal silicon, gallium arsenide (GaAs) or other crystalline ingot, is shown. The apparatus 10 comprises, in pertinent part, a cutting wire 12, for example a diamond impregnated wire such as the Superwire™ or Superlok™ series of cutting wires available from Laser Technology West Limited, Colorado Springs, Colo. The wire 12 is utilized in conjunction with the method and apparatus 10 of the present invention to accurately and rapidly crop and saw a silicon ingot 14 into multiple wafers for subsequent processing into discrete or integrated circuit devices.

The apparatus 10 includes a wire drive mechanism 16 for moving the wire 12 in a single direction as indicated by the arrow or in a reciprocating fashion with respect to the ingot 14. The wire drive mechanism 16, in the embodiment shown, may comprise a capstan 18 for alternately winding and unwinding the wire 12 about a central pulley to impart a reciprocating motion to the wire 12. Alternatively, if one or more individual continuous loops of wire 12 are utilized instead of a single linear length of wire, the wire 12 may be readily moved continuously in a single direction without reversal as described more fully hereinafter. As shown, the wire 12 may be guided in the proximity of the ingot 14 by a pair of pulleys 20, with proper tensioning of the wire 12 being maintained by a tension pulley 22.

The apparatus 10 further includes a workpiece rotation mechanism 24 for rotating the ingot 14 about its longitudinal axis as the wire 12 is moved orthogonally with respect to the ingot 14 in either a single direction or bidirectionally as previously described. The workpiece rotation mechanism 24, in the embodiment shown, may comprise one or more rotating collet fixtures 26 circumferentially surrounding the ingot 14 along its length thereof as will be more fully described hereinafter. The collet fixtures, and hence the ingot 14, may be rotated by means of a number of drive rollers 28 or functionally equivalent elements. In an alternative embodiment, the ingot 14 may be secured to an end mounted workpiece rotation mechanism 24 in lieu of the embodiment illustrated in this figure.

The apparatus 10 also includes a wire advancing mechanism 30 to which, in this first embodiment illustrated, the wire drive mechanism is mounted. The wire advancing mechanism 30 functions to advance the moving wire 12 from an initial position 32 displaced outwardly from, and proximate to, the outer diameter ("OD") of the ingot 14 towards a final position 34 proximate the inner diameter ("ID") of the ingot 14 to effectuate completion of a single cut. At this ID point, the motion of the wire advancing mechanism may be reversed to withdraw the wire 12 back towards the initial position 32.

In those applications wherein repeated cuts or slices through the ingot 14 are desired, the apparatus 10 may further incorporate a workpiece repositioning mechanism 36 to enable an indexed, translational repositioning of the ingot 14 to enable the wire 12 to make repeated cuts along its length, for example, to slice a number of wafers therefrom. In the embodiment shown, the workpiece repositioning mechanism 36 may include a programmably index driven leadscrew 38 which reposition the workpiece rotation mechanism 24 and ingot 14 as supported by a number of rollers 40 with respect to the wire 12. In alternative embodiments, the wire drive mechanism 16 and wire advancing mechanism 30 may be repositionable with respect to a generally fixed position workpiece rotation mechanism 24.

With reference additionally now to FIGS. 2, 3, 4A and 4B, more detailed illustrations of a particular exemplary implementation of an apparatus 10 as previously depicted and described with respect to FIG. 1 are shown. With respect to the apparatus 10 illustrated in these figures, like structure to that previously described and shown is like numbered and the foregoing description hereof shall suffice herefor.

Figure 2:
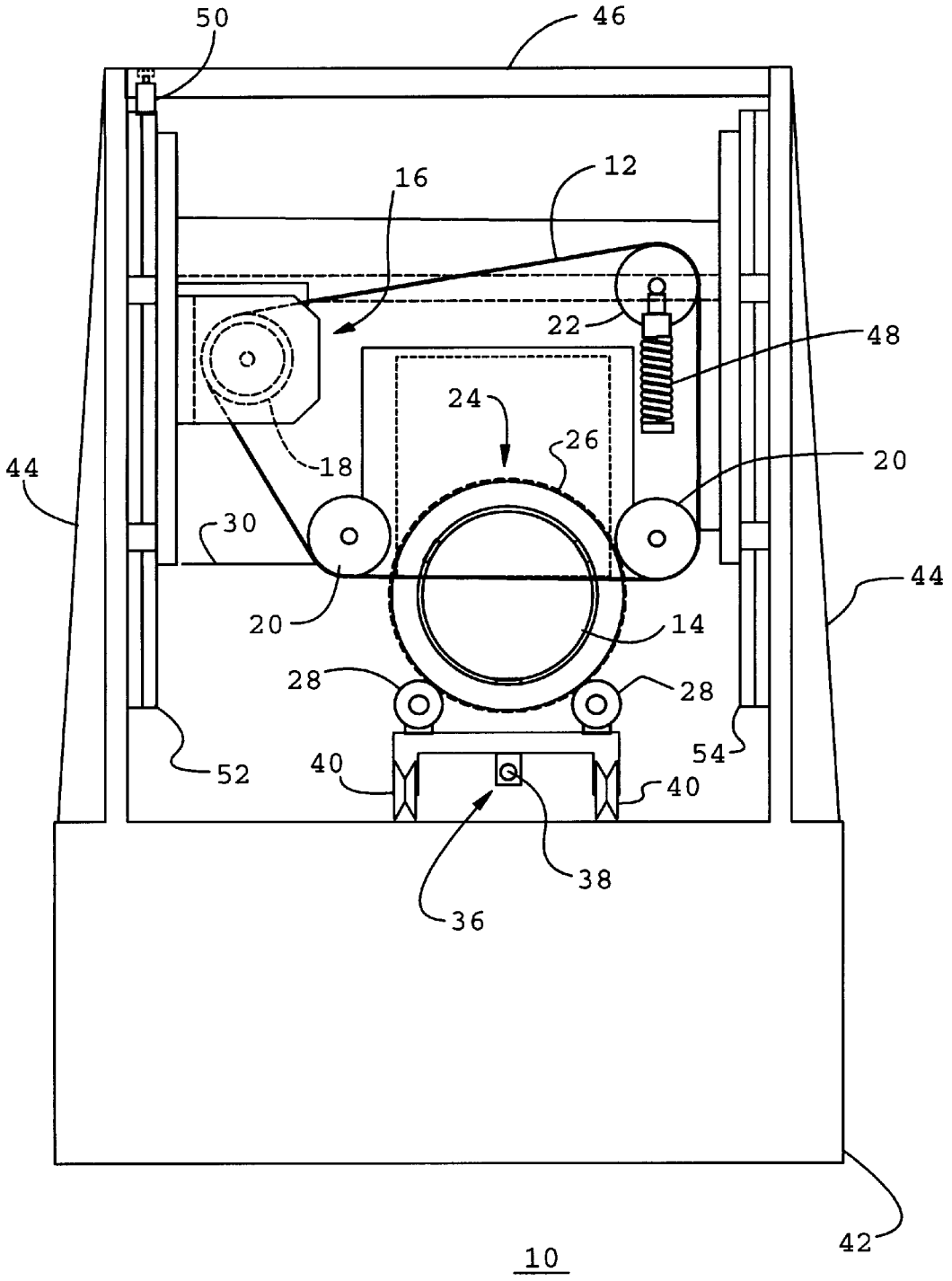
FIG. 2 is a more detailed, partially cut-away end elevational view of the apparatus of FIG. 1 wherein the ingot is rotated by means of a rotating collet fixture while the cutting wire is driven substantially tangentially to the circumference of a cut in the ingot.

With particular reference to FIG. 2, it can be seen that the apparatus 10 may comprise a base 42 providing a worktable surface with a pair of upwardly extending upright supports 44. One or more crossbeams 46 may extend between the distal ends of the upright supports 44 as shown. Also illustrated is a wire tensioner 48 for maintaining an appropriate wire 12 tension for the wire drive mechanism 16. The wire tensioner 48 may comprise a spring or other suitable means for biasing the tension pulley 22 to maintain proper tension of the wire 12 during a sawing operation. The wire advancing mechanism 30 is slidably supported by the upright supports 44 and may comprise a microstepper feed drive 50 in conjunction with a driven linear actuator 52 and corresponding idler linear actuator 54, each of the actuators 52, 54 being associated with a corresponding one of the upright supports 44.

Figure 3:
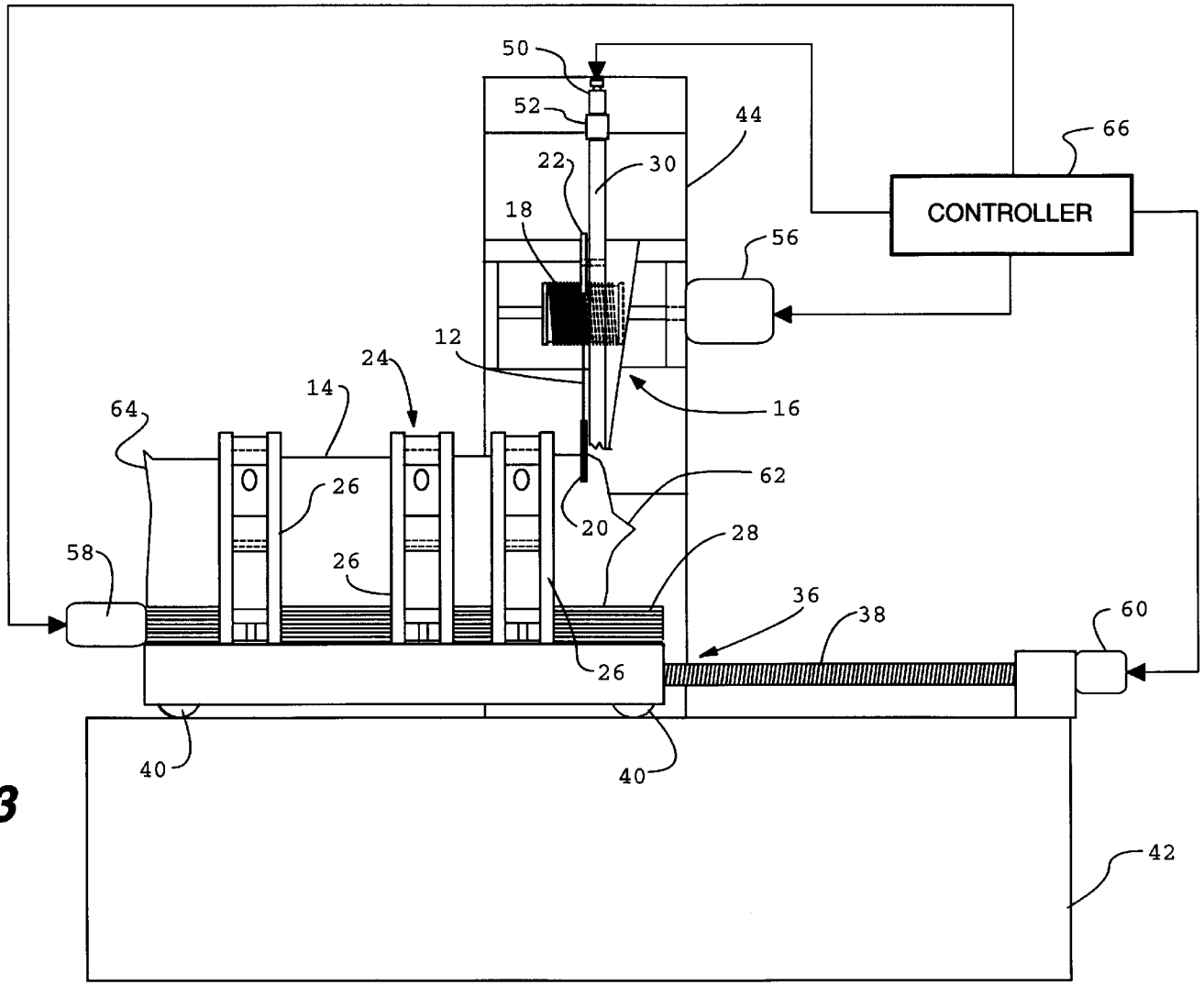
FIG. 3 is a detailed, partially cut-away side elevational view of the apparatus of FIGS. 1 and 2 illustrating the rotating collet fixtures and an associated lead screw for translationally repositioning the workpiece between cuts to define a number of wafers to be sliced from the ingot.

With particular reference to FIG. 3, the capstan 18 of the wire drive mechanism 16 may be driven by a drive motor 56 as shown while a microstepper 58 may be utilized to rotate one or both of the drive rollers 28 of the workpiece rotation mechanism 24. In the embodiment shown, the drive rollers 28 may include a plurality of longitudinally extending teeth for engaging corresponding peripherally extending teeth of the collet fixtures 26. The collet fixtures 26 may further comprise centering clamps (not shown) to enable the ingot 14 to be accurately centered within the collet fixtures 26 to enable accurate rotation about its longitudinal axis during operation of the apparatus 10.

Figure 4A:
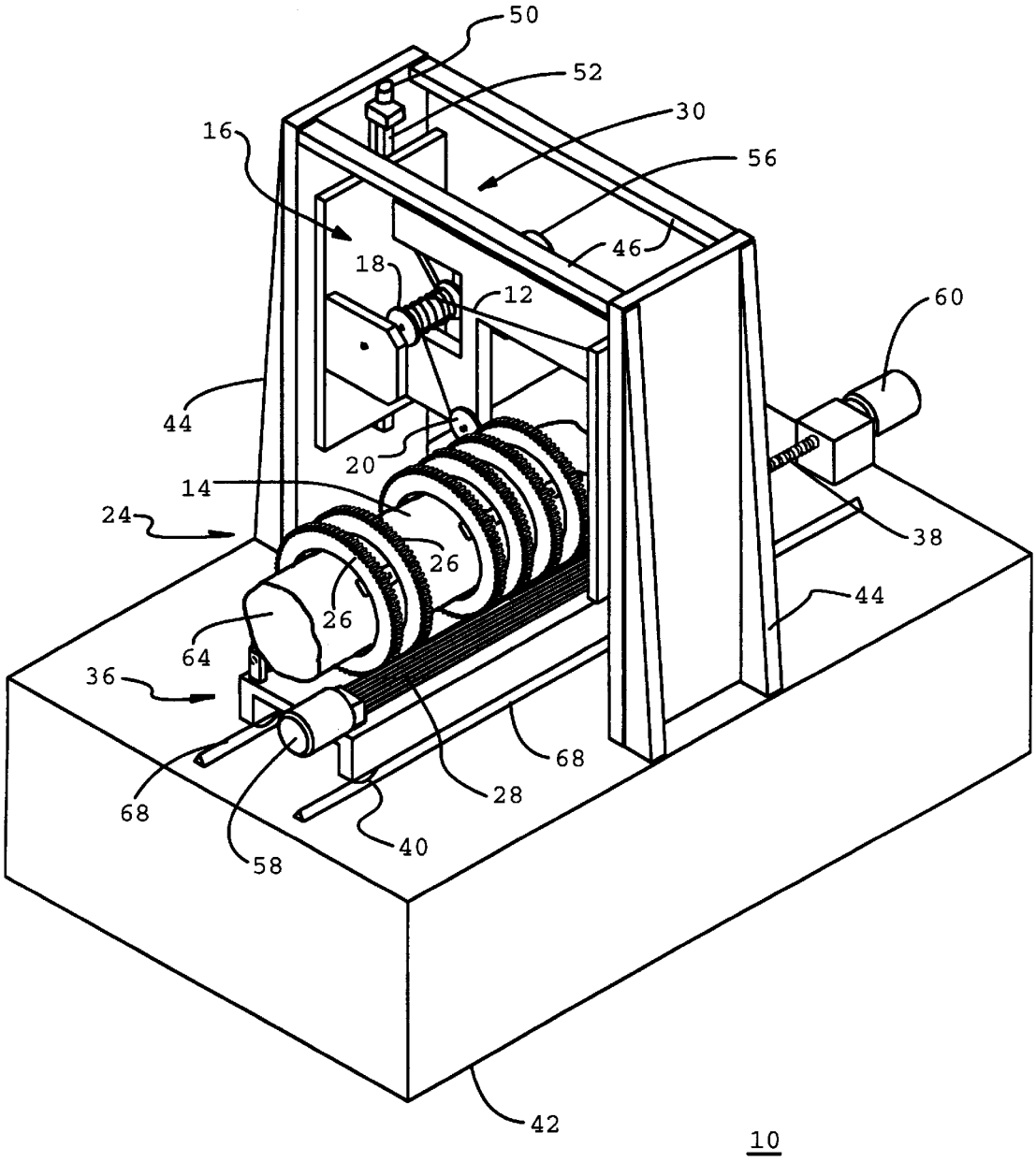
FIGS. 4A and 4B are differing, detailed isometric views of the apparatus of FIGS. 2 and 3, further illustrating the interrelationship of the wire drive, workpiece rotation, wire advancing and workpiece repositioning mechanisms.
Figure 4B:
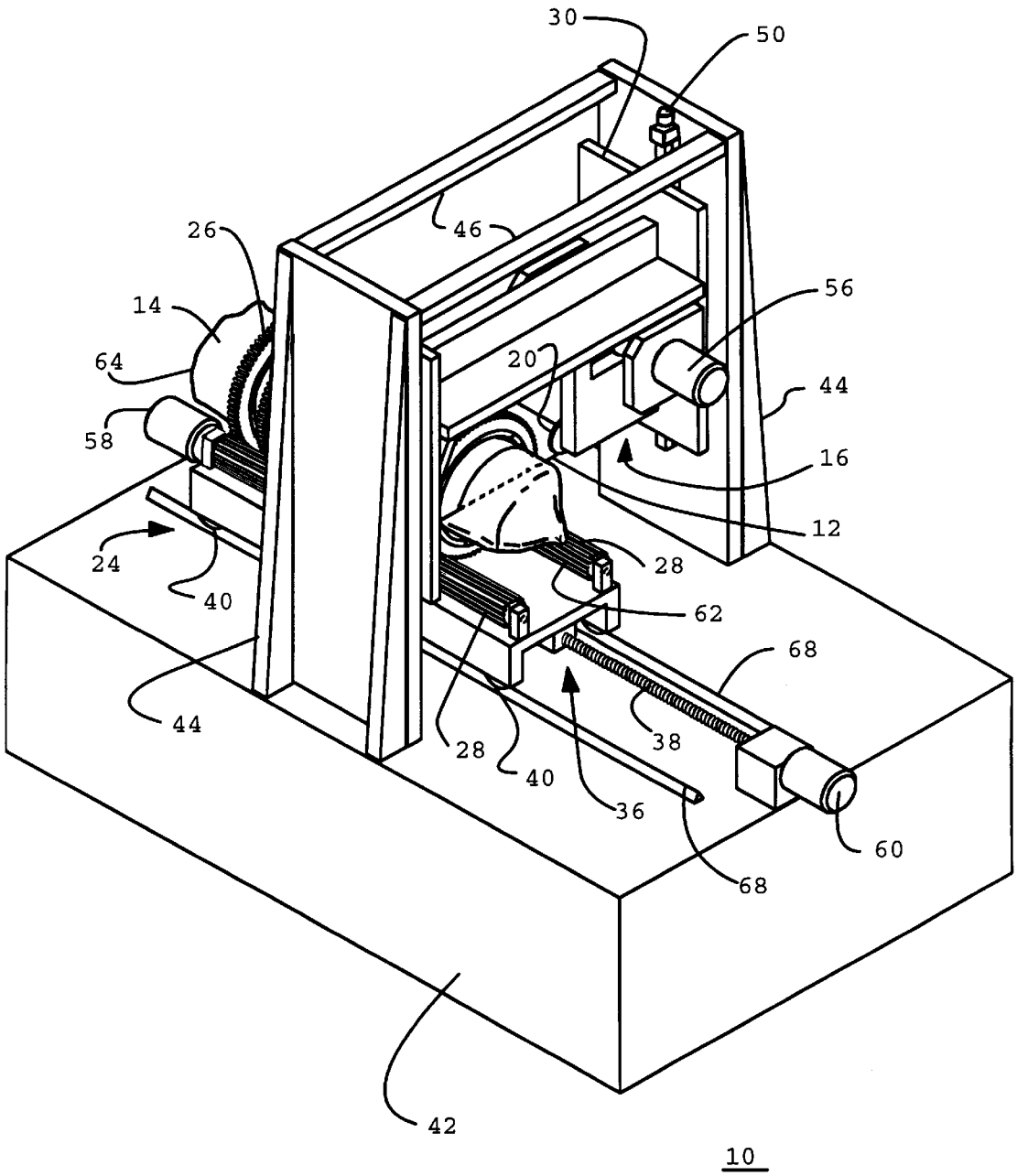

As also shown, the apparatus 10 may further include a microstepper 60 coupled to the leadscrew 38 of the workpiece repositioning mechanism 36 to enable the carriage supporting the ingot 14 and associated workpiece rotation mechanism 24 to be selectively moved along the worktable of the base 42 to reposition the ingot 14 with respect to the wire drive mechanism 16. Figures 4A and 4B further illustrate that the rollers 40 may be engaged to a pair of rails 68 to facilitate accurate translational positioning of the ingot 14 by means of the microstepper 60. As shown, prior to a cropping operation which may also be performed by the apparatus 10 in addition to wafer slicing, the ingot 14 also includes a somewhat tapered head 62 and opposing flanged tail 64.

The apparatus 10 further comprises a controller 66 coupled to and operationally controlling the functionality and inter-relational operation of one or more of the microstepper feed drive 50 of the wire advancing mechanism 30, the drive motor 56 of the wire drive mechanism 16, the microstepper 58 of the workpiece rotation mechanism 24 and the microstepper 60 of the workpiece repositioning mechanism 36 as will be more fully described hereinafter.

Figure 5:
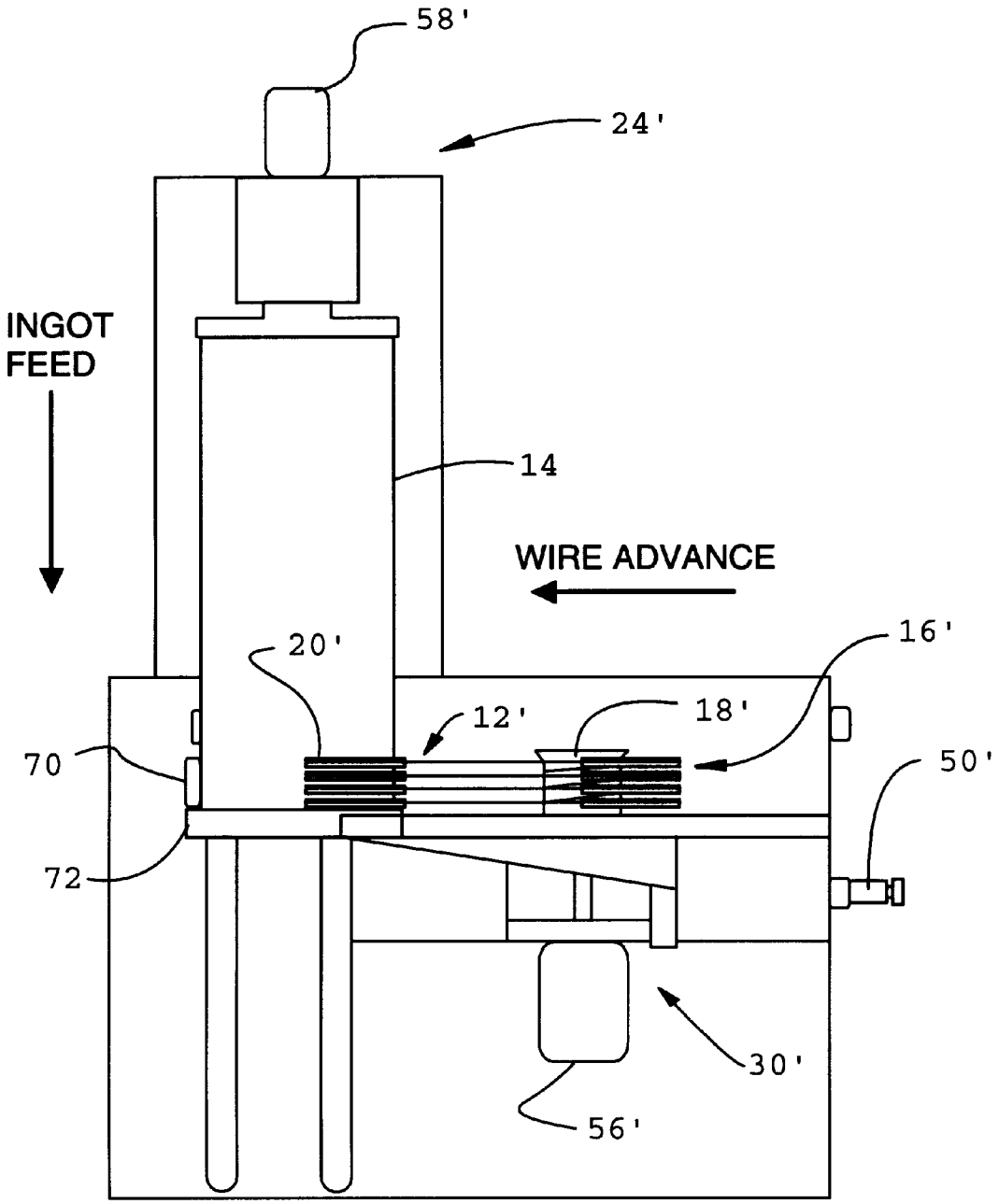
FIG. 5 is an additional detailed partially cut-away side elevational view of an alternative embodiment of the present invention utilizing, for example, multiple cutting wires and wherein the ingot is rotated by means of an end mounted workpiece rotation mechanism secured adjacent an end of the ingot.

With reference additionally now to FIG. 5, an alternative exemplary embodiment of an apparatus $\mathbf{10}^1$in accordance with the present invention is shown. The apparatus $\mathbf{10}^1$ incorporates a plurality of cutting wires $\mathbf{12}^1$ in the form of individual closed-loop wires to enable simultaneous cuts to be made in the ingot 14 to slice individual wafers therefrom. The wires $\mathbf{12}^1$ of the wire drive mechanism $\mathbf{16}^1$ are supported by a number of pulleys $\mathbf{20}^1$ and may be driven by means of a capstan $\mathbf{18}^1$ as rotationally coupled to a single direction of rotation drive motor 561. The wire advancing mechanism $\mathbf{30}^1$ of the apparatus $\mathbf{10}^1$ moves the wire drive mechanism $\mathbf{16}^1$ in a horizontal direction with respect to the vertically positioned ingot 14 by means of a microstepper feed drive $\mathbf{50}^1$. The workpiece rotation mechanism $\mathbf{24}^1$, in the embodiment shown, is mounted and secured to a cropped end of the ingot 14 and is driven by a microstepper $\mathbf{58}^1$. Also as shown, the apparatus $\mathbf{10}^1$ includes catch jaws 70 and a catch table 72 for wafers cut from the ingot 14 as well as an ingot feed, or workpiece repositioning mechanism, (not shown) to position the ingot 14 with respect to the wire drive mechanism $\mathbf{16}^1$.

In the embodiment of the apparatus 10 above-described with respect to FIGS. 1–4B, the capstan 18 may hold 100 to 200 linear feet of wire 12 and reversibly drive the wire 12 at a rate of 2000 to 2500 feet/second. However, in certain applications it may be desirable to utilize one or more continuous loops of wire $\mathbf{12}^1$ (as shown, for example, in FIG. 5) in conjunction with a wire drive mechanism $\mathbf{16}^1$ which moves the one or more wires $\mathbf{12}^1$ in a single direction only without the necessity of reversing its direction. As presently understood, such continuous loop(s) of wire $\mathbf{12}^1$ would last longer in operation than a comparable reversing length of wire 12, would tend to seat better within the resultant cut in the ingot 14 while also obviating any serration marks that might result due to the reversing of the wire 12 and provide a significantly reduced cutting time in comparison.

In each of the embodiments described above, the rotation of the ingot 14 in conjunction with the motion of the wire 12 means that the wire is only in contact substantially tangentially to the circumference of the ingot 14 and the cut produced throughout the entire cutting operation. This results in much less drag on the wire 12 allowing for faster cutting while concomitantly providing for the use of a finer gauge wire than would otherwise be the case if the cut were to have to proceed from the ingot 14 OD to the maximum diameter of the ingot 14 through its center point. This potential use of a finer gauge wire 12 means that there will be less loss of the ingot 14 material in the sawing operation and the cleaner cut produced lessens the need for extensive lapping thereafter thereby reducing the cost of lapping materials and operations.

In operation, the wire 12 speed imparted by the wire driving mechanism 16, the ingot 14 rotation speed imparted by the workpiece rotation mechanism 24 and the advance of the wire 12 into the ingot 14 due to the wire advancing mechanism 30 must be accurately controlled, for example by the controller 66 (FIG. 3). Functionally, it is most desirable that the surface speed of the wire 12 with respect to the material of the ingot 14 be held relatively constant. Therefore, the relative speed of the wire 12 has to be reduced as the cut proceeds from the ingot 14 OD to its ID to keep the surface rate substantially constant. The cutting pressure of the wire 12 is determined by the wire advancing mechanism 30.

With the horizontal cutting arrangement illustrated in FIGS. 1–4A and 4B in particular, water may be utilized in the cutting operation as a lubricant for the wire 12 to wash off the crystalline debris and prolong the cutting life of the wire 12. Other suitable techniques may also be employed with respect to the embodiment shown in FIG. 5.

In the first embodiment, the ingot 14 is rotated relative to the wire 12 while the wire 12 is either tangentially reciprocated or continuously advanced so that the cut is tangentially made around the circumference of the ingot as the wire 12 advances from the OD to the ID or center of the ingot 14. This same relative motion may be accomplished by holding the ingot 14 stationary and instead rotating the wire 12 about the longitudinal axis of the ingot 14 as the wire 12 is reciprocated or continually advanced.

Figure 6A:
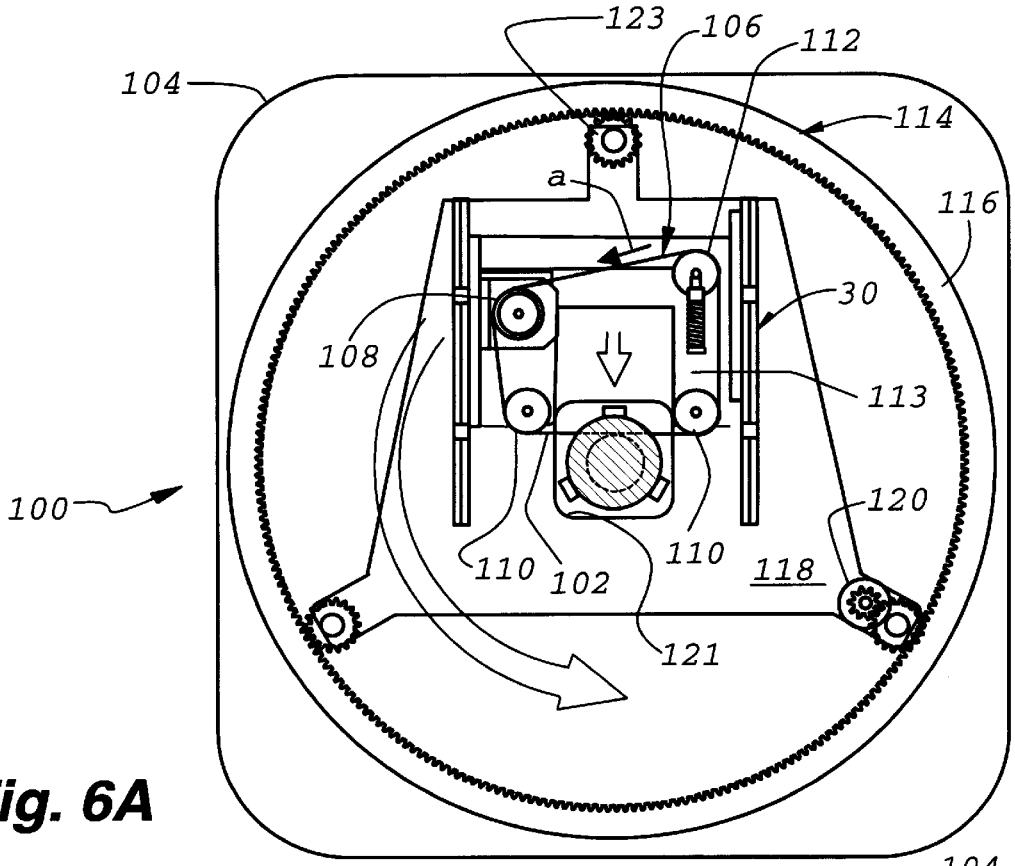
FIG. 6A and 6B are simplified representational plan views of an apparatus for slicing a workpiece, in particular a single crystal silicon ingot, in accordance with another exemplary implementation of the present invention in which the saw is rotated about the workpiece during the cutting operation.
Figure 6B:
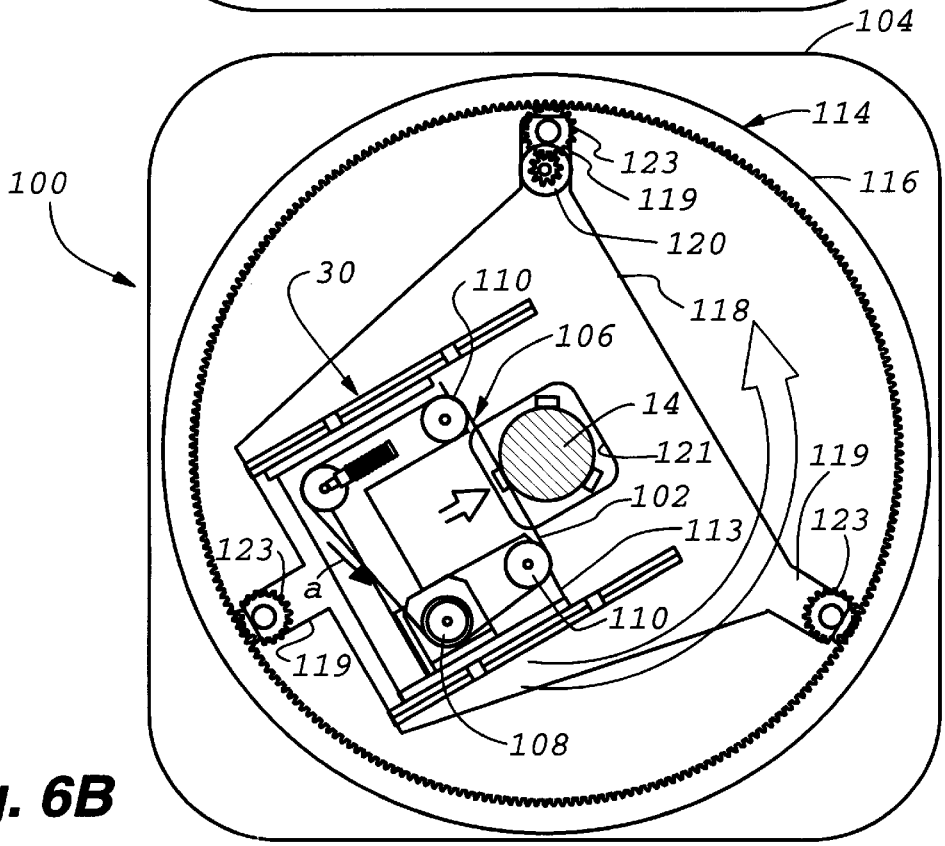

Referring now to FIGS. 6A and 6B, a second preferred embodiment 100 of the present invention is shown in plan views. FIG. 6A shows the apparatus with the wire saw at an intermediate cut depth between the OD and the ID of the ingot 14. FIG. 6B shows the apparatus with the wire saw against the OD of the ingot 14 and at a different angular position as will be described further below.

The apparatus 100 comprises, in pertinent part, a cutting wire 102, for example a diamond impregnated wire such as the Superwire™ or Superlok™ series of cutting wires available from Laser Technology West Limited, Colorado Springs, Colo. The wire 102 is utilized in conjunction with the method and apparatus 100 of the present invention to accurately and rapidly crop and saw a silicon ingot 14 into multiple wafers for subsequent processing into discrete or integrated circuit devices by rotating the saw relative to a stationary ingot 14.

The apparatus 100 includes a stationary frame 104 and a wire drive mechanism 106 for moving the wire 102 in a single direction as indicated by the arrow "a" or in a reciprocating fashion with respect to the ingot 14. The wire drive mechanism 106, in the second embodiment shown, may comprise a capstan 108 for alternately winding and unwinding the wire 102 about a central pulley to impart a reciprocating motion to the wire 102. Alternatively, if one or more individual continuous loops of wire 102 are utilized instead of a single linear length of wire, the wire 102 may be readily moved continuously in a single direction without reversal. As shown, the wire 102 may be guided in the proximity of the ingot 14 by a pair of pulleys 110, with proper tensioning of the wire 102 being maintained by a tension pulley 112. The capstan and pulleys are all mounted to a wire drive mechanism frame 113.

The apparatus 100 further includes a wire (i.e. saw) drive mechanism rotation mechanism 114 for rotating the wire drive mechanism 106 about the ingot's longitudinal axis as the wire 102 is moved orthogonally with respect to the ingot 14 in either a single direction or bidirectionally as previously described.

The wire saw rotation mechanism 114, in the second preferred embodiment shown in FIG. 6, may comprise a stationary peripheral ring gear 116 centered about the support for the ingot 14 on the stationary frame 104, an annular support disk 118 concentrically mounted about the longitudinal axis of the ingot 14 for rotation therearound within the ring gear 116 and a drive motor and gear 120 mounted on either the frame 104 or the support disk 118 to rotate the annular support disk 118 about its central axis and thus the longitudinal axis of the ingot 14.

As shown in FIGS. 6A and 6B, the ingot 14 is mounted in a chuck held in a stationary position on the frame 104. The drive motor 120 is mounted on one leg 119 of the annular support disk 118. Further, the support disk 118 is shown as having a generally trapezoidal shape with three legs 119 spaced 120 degrees apart and a central generally rectangular opening 121 around the ingot 14. Each leg 119 supports a gear 123 which engages the teeth on the ring gear 112 and thus ensures that the support disk 118 remains centered about the ingot 14. Two of the gears 123 are simply followers. The gear 123 meshed with the drive gear on the motor 120 is the driven gear which rotates the trapezoidal annular disk 114. This motor 120 may be a stepper motor or other suitable fine controllable motor to effectuate the required angular velocity required for the cutting operation as is more fully described with reference to the first embodiment set forth above.

The shape of the disk 114 being trapezoidal is purely exemplary. The shape may be circular, triangular or have a different shape all together, but, in this embodiment, it is generally annular with a central opening positioned around the support for the ingot 14. The annular support disk or plate 118 rotates around the ingot 14 since the wire drive mechanism 106 is fastened to the annular support disk 118. Since the annular support disk 118 rotates around the ingot 14, the wire 102 in turn rotates around the ingot 14 while remaining tangential to the cut in the ingot 14 as the wire 102 is driven by the wire drive mechanism 106.

The apparatus 100 also includes a wire advancing mechanism 30 as in the first embodiment 10 to which, in the second embodiment 100 illustrated in FIGS. 6A and 6B, the wire drive mechanism 106 is mounted. The wire advancing mechanism 30 acts as a radially move the frame 113 for the wire drive mechanism 106 and is itself fastened to the rotating annular support disk 118. The wire advancing mechanism 30 functions to advance wire drive mechanism 106, and thus the moving wire 102, from an initial position, as is shown in FIG. 6B, proximate to the outer diameter ("OD") of the ingot 14, through an intermediate position as shown in FIG. 6A, towards a final position proximate the inner diameter ("ID") of the ingot 14 to effectuate completion of a single cut while the saw rotation system 114 rotates the entire wire advancing mechanism 30 and the wire drive mechanism 106 around the ingot 14 via the motor 120. When the wire 102 reaches the inner diameter or center longitudinal axis of the ingot 14, the ingot 14 is severed and the motion of the wire advancing mechanism 30 may be reversed to withdraw the wire 102 back towards the initial position 32.

In operation, the speed imparted to the wire 102 by the wire driving mechanism 106, the saw rotation speed imparted by the saw rotation mechanism 114 and the radial inward advance of the wire 102 into the ingot 14 due to the wire advancing mechanism 30 all must be accurately controlled. Functionally, it is most desirable that the surface speed of the wire 102 with respect to the material of the ingot 14 be held relatively constant. Therefore, as in the first embodiment, the relative speed of the wire 102 with respect to the ingot 14 has to be reduced as the cut proceeds from the ingot 14 OD to its center or ID to keep the surface rate substantially constant. As in the first embodiment, the cutting pressure of the wire 102 is determined by the wire advancing mechanism 30.

The two embodiments 10 and 100 described and shown function very similarly from the perspective of the ingot 14. In both embodiments, the wire 12 and 102 moves around the circumference of the ingot 14 while at the same time cutting tangentially into the ingot 14 orthogonally to the longitudinal axis of the ingot. This relative motion between the saw wire and the ingot 14 results in an extremely narrow cut and uniform kerf being maintained in the ingot during the cut and minimizes the depth of cut required to sever the ends of the ingot and/or wafers from the ingot.

While there have been described above the principles of the present invention in conjunction with specific apparatus and wire sawing techniques, it is to be clearly understood that the foregoing description is made only by way of example and not as a limitation to the scope of the invention. Particularly, it is recognized that the teachings of the foregoing disclosure will suggest other modifications to those persons skilled in the relevant art. Such modifications may involve other features which are already known per se and which may be used instead of or in addition to features already described herein. Although claims have been formulated in this application to particular combinations of features, it should be understood that the scope of the disclosure herein also includes any novel feature or any novel combination of features disclosed either explicitly or implicitly or any generalization or modification thereof which would be apparent to persons skilled in the relevant art, whether or not such relates to the same invention as presently claimed in any claim and whether or not it mitigates any or all of the same technical problems as confronted by the present invention. The applicants hereby reserve the right to formulate new claims to such features and/or combinations of such features during the prosecution of the present application or of any further application derived therefrom.

What is claimed is:

1. A method for sectioning a substantially cylindrical crystalline workpiece comprising the steps of:

providing a wire having a plurality of cutting elements affixed thereto;

providing a wire drive mechanism for moving said wire;

holding said substantially cylindrical crystalline workpiece in a stationary position;

moving said wire orthogonally to a longitudinal axis of said workpiece to form a cut in said workpiece;

rotating said wire drive mechanism through at least an arc around said workpiece to form said cut substantially tangentially around said workpiece; and advancing said wire from a first position proximate an outer diameter of said workpiece to a second position proximate an inner diameter thereof as said wire deepens said cut.

2. The method of claim 1 wherein said step of rotating is carried out by rotating said wire about said longitudinal axis of said workpiece.

3. The method of claim 1 wherein said step of moving is carried out by the step of:

linearly drawing said wire in one direction with respect to said longitudinal axis of said workpiece.

4. The method of claim 1 wherein said step of moving is carried out by the steps of:

linearly drawing said wire in a first direction with respect to said longitudinal axis of said workpiece; and alternately drawing said wire in a second opposite direction with respect to said longitudinal axis of said workpiece.

5. The method of claim 1 wherein said steps of moving and rotating are velocity related.

6. The method of claim 5 wherein said step of rotating is carried out at a substantially uniform angular velocity and said step of moving is carried out at a variable velocity decreasing as said wire is advanced from said first position to said second position.

7. The method of claim 5 wherein said step of moving is carried out at a substantially uniform velocity and said step of rotating is carried out at a variable angular velocity decreasing as said wire is advanced from said first position to said second position.

8. The method of claim 1 wherein said step of advancing is carried out at a substantially uniform velocity from said first position to said second position.

9. The method of claim 1 further comprising the step of:

withdrawing said wire from said second position to said first position.

10. The method of claim 9 further comprising the step of:

repositioning said workpiece with respect to said wire and repeating said steps of moving, rotating and advancing.

11. The method of claim 1 wherein said steps of providing and moving further comprise the steps of:

providing a plurality of wires in a generally parallel and spaced apart relationship therebetween, each of said wires having a plurality cutting elements affixed thereto; and simultaneously moving said plurality of wires orthogonally to a longitudinal axis of said workpiece.

12. An apparatus for sectioning a substantially cylindrical crystalline workpiece comprising:

a wire having a plurality of cutting elements affixed thereto;

a wire drive mechanism for moving said wire orthogonally with respect to a longitudinal axis of said workpiece;

a rotation mechanism coupled to said wire drive mechanism for rotating said wire drive mechanism about said longitudinal axis; and a wire advancing mechanism for advancing said wire from a first position proximate an outer diameter of said workpiece to a second position proximate an inner diameter thereof.

13. The apparatus of claim 12 wherein said wire comprises a plurality of diamonds impregnated in said wire.

14. The apparatus of claim 13 wherein said wire comprises a steel core having a circumferentially surrounding copper sheath.

15. The apparatus of claim 14 wherein said plurality of diamonds are impregnated in said copper sheath.

16. The apparatus of claim 15 wherein said wire further comprises a nickel layer overlying said copper sheath.

17. The apparatus of claim 15 wherein said plurality of diamonds are substantially uniformly distributed about a circumference and length of said wire.

18. The apparatus of claim 12 wherein said wire drive mechanism is operative to linearly draw said wire in a one direction with respect to said longitudinal axis of said workpiece.

19. The apparatus of claim 18 wherein said wire comprises a closed loop of wire.

20. The apparatus of claim 12 wherein said wire drive mechanism is operative to linearly draw said wire in a first direction with respect to said longitudinal axis of said workpiece and alternately draw said wire in a second opposite direction with respect to said longitudinal axis of said workpiece.

21. The apparatus of claim 20 wherein said wire comprises an elongate length of wire.

22. The apparatus of claim 12 wherein said rotation mechanism comprises an annular ring gear coaxially mounted about said workpiece and a wire drive mechanism support rotatably coupled to said ring gear for rotating said wire drive mechanism about said longitudinal axis.

23. The apparatus of claim 22 wherein said ring gear is stationary.

24. The apparatus of claim 12 further comprising:

a plurality of a wires in a generally parallel and spaced apart relationship therebetween, each of said wires having a plurality of cutting elements affixed thereto, said wire drive mechanism for moving said plurality of wires orthogonally with respect to said longitudinal axis of said workpiece.

25. A semiconductor wafer made by a process comprising the steps of:

providing a wire having a plurality of cutting elements affixed thereto;

providing a wire drive mechanism for moving said wire;

moving said wire orthogonally to a longitudinal axis of a crystalline semiconductor material ingot and simultaneously rotating said wire drive mechanism through at least an arc about said longitudinal axis; and advancing said wire from a first position proximate an outer diameter of said ingot to a second position proximate an inner diameter thereof.

26. The semiconductor wafer of claim 25 wherein said step of providing is carried out by means of a diamond impregnated wire.

27. The semiconductor wafer of claim 25 wherein said step of moving includes the step of:

linearly drawing said wire in one direction with respect to said longitudinal axis of said ingot while rotating said wire with respect to said longitudinal axis of ingot.

28. The semiconductor wafer of claim 25 wherein said step of moving includes the steps of:

linearly drawing said wire in a first direction with respect to said longitudinal axis of said ingot; and alternately drawing said wire in a second opposite direction with respect to said longitudinal axis of said ingot.

29. The semiconductor wafer of claim 25 wherein said steps of moving and rotating are velocity related.

30. The semiconductor wafer of claim 29 wherein said step of rotating is carried out at a substantially uniform angular velocity and said step of moving is carried out at a variable velocity decreasing as said wire is advanced from said first position to said second position.

* * * * *